US009016098B2

(12) United States Patent
Larroche et al.

(10) Patent No.: US 9,016,098 B2
(45) Date of Patent: Apr. 28, 2015

(54) PROCESS FOR FORMING THE WALL OF THE MOUTH OF A METAL CONTAINER OR PACKAGING, DEVICE FOR THIS PURPOSE AND PACKAGING OR CONTAINER OBTAINED

(75) Inventors: Jean Larroche, Pujols (FR); Francisco Serna, Las Torrres de Cotillas (ES)

(73) Assignee: Sodetch Sarl, la Teste de Buch (FR)

( * ) Notice: Subject to any disclaimer, the term of this patent is extended or adjusted under 35 U.S.C. 154(b) by 473 days.

(21) Appl. No.: 13/424,877

(22) Filed: Mar. 20, 2012

(65) Prior Publication Data

US 2012/0243963 A1 Sep. 27, 2012

(30) Foreign Application Priority Data

Mar. 22, 2011 (FR) ..... 11 00864

(51) Int. Cl.

| | |
|---|---|
| ***B21D 22/16*** | (2006.01) |
| ***B21D 51/38*** | (2006.01) |
| ***B21D 51/26*** | (2006.01) |
| ***B21D 39/20*** | (2006.01) |
| ***B65D 81/20*** | (2006.01) |
| ***B65D 6/38*** | (2006.01) |

(52) U.S. Cl.

CPC ..... *B21D 51/2607* (2013.01); *B21D 39/20* (2013.01); *B21D 51/2615* (2013.01); *B21D 51/2623* (2013.01); *B21D 51/263* (2013.01); *B21D 51/2638* (2013.01); *B65D 81/2015* (2013.01); *B65D 7/46* (2013.01)

(58) Field of Classification Search

USPC ..... 413/76, 8, 71; 72/84, 91, 94, 96, 97, 72/104, 105, 115, 117, 124

See application file for complete search history.

(56) References Cited

U.S. PATENT DOCUMENTS

| | | | | |
|---|---|---|---|---|
| 2,335,260 A | | 11/1943 | Chamberlain | |
| 3,967,488 A | * | 7/1976 | Hasselbeck et al. | 72/91 |
| 4,870,847 A | | 10/1989 | Kitt | |
| 4,927,043 A | | 5/1990 | Vanderlaan | |
| 5,152,417 A | | 10/1992 | Gallagher | |

FOREIGN PATENT DOCUMENTS

EP 1 975 076 A1 10/2008

OTHER PUBLICATIONS

French Search Report, dated Nov. 17, 2011, from corresponding French application.

* cited by examiner

*Primary Examiner* — Debra Sullivan
(74) *Attorney, Agent, or Firm* — Young & Thompson

(57) ABSTRACT

A process of forming the wall of the mouth of a cylindrical, metal container or packaging from a tubular ring that may or may not be molded that has to accommodate a sealing lid equipped with an elastic seal secured by a vacuum created in the container is characterized essentially by the use of a single element, the head carrying out the deformation of the internal diameter of the container by expansion to produce a bead together and simultaneously with a contraction that produces shrinkage above the bead of the mouth, the head comprising an expansible stationary part and a moving part that turns around the stationary part, the parts of the head being coaxial, which has the effect of compressing the metal and hardening it by organizing the metal molecules under two simultaneous stresses, which hardens the packaging and allows it to withstand the vacuum applied thereto.

16 Claims, 8 Drawing Sheets

Figure 1:
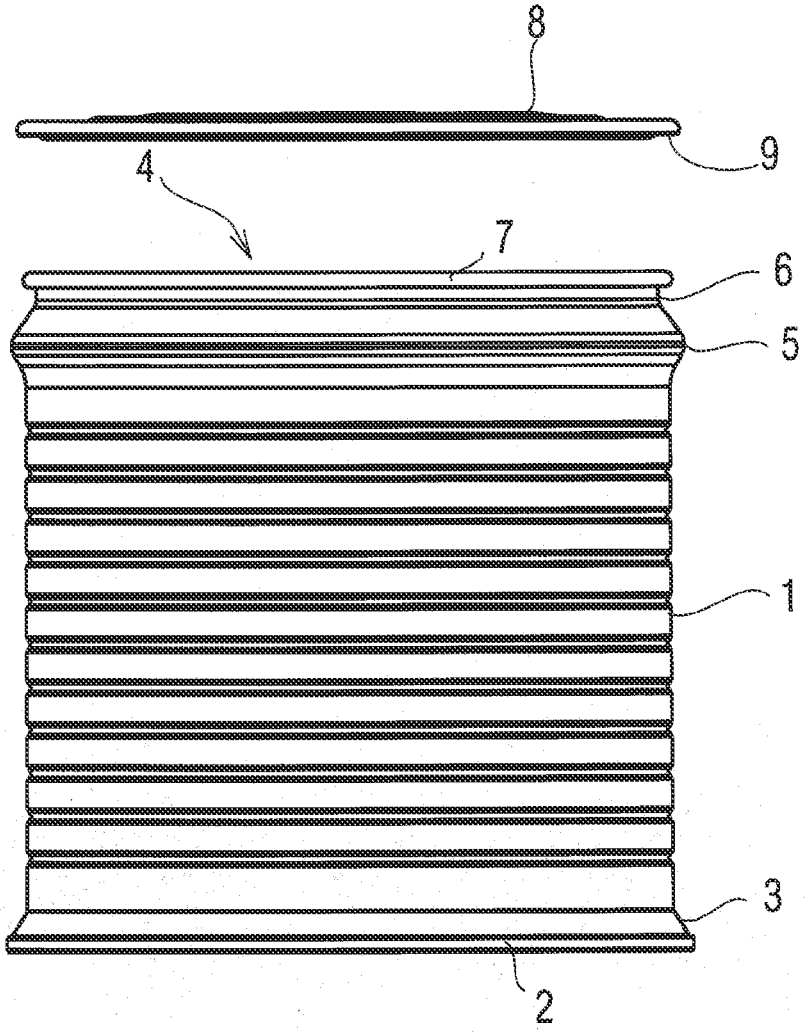

PROCESS FOR FORMING THE WALL OF THE MOUTH OF A METAL CONTAINER OR PACKAGING, DEVICE FOR THIS PURPOSE AND PACKAGING OR CONTAINER OBTAINED

BACKGROUND OF THE INVENTION

This invention relates to a process for forming the wall of the mouth of a metal container or packaging and the device for this purpose and the packaging or container obtained.

The packaging, according to the invention, is produced from a tubular ring that may or may not be molded to improve its strength.

DESCRIPTION OF THE RELATED ART

The packaging or container in question is of the type that should accommodate a lid equipped with an elastic seal and secured by the vacuum created in the pre-filled container, at the top of said container, with said vacuum being able to be obtained according to the technology defined according to the patents or patent applications previously filed by the company SODETECH:

- N° 01.11155/2,829,106 of Aug. 28, 2001 for: "process and device for the vacuum sealing of a container for foodstuffs;"
- N° 09.00966/2,942,618 of Mar. 2, 2009 for: "process and installation for continuous vacuum packaging of food products;"
- N° 10.00602 of Feb. 12, 2010 for "steam and cold water injection head for carrying out continuous vacuum packaging of food products."

These references illustrate the research conducted by the applicant company in the use of a deep vacuum both to facilitate sterilization while preserving as much as possible the natural organoleptic qualities of the products as well as to facilitate sealing by the lid.

The concept of deep vacuum is variable on the order of 900 mb (nine hundred millibars) at the temperature of four degrees Centigrade.

SUMMARY OF THE INVENTION

To this end, this invention relates to both the process for forming the wall of the mouth of the container and the container obtained and the device for this purpose.

The process, according to the invention, of forming the wall of the mouth of a cylindrical, metal container or packaging from a tubular ring that may or may not be molded that has to accommodate a sealing lid equipped with an elastic seal secured by a vacuum created in the container is characterized essentially by the use of a single element, the head carrying out the deformation of the internal diameter of the container by expansion to produce a bead together and simultaneously with a contraction that produces shrinkage above the bead of the mouth, the head comprising an expansible stationary part and a moving part that turns around the stationary part, said parts of the head being coaxial, which has the effect of compressing the metal and hardening it by organizing the metal molecules under two simultaneous stresses, which hardens the packaging and allows it to withstand the vacuum that is applied to it.

BRIEF DESCRIPTION OF THE DRAWING FIGURES

Figure 5:
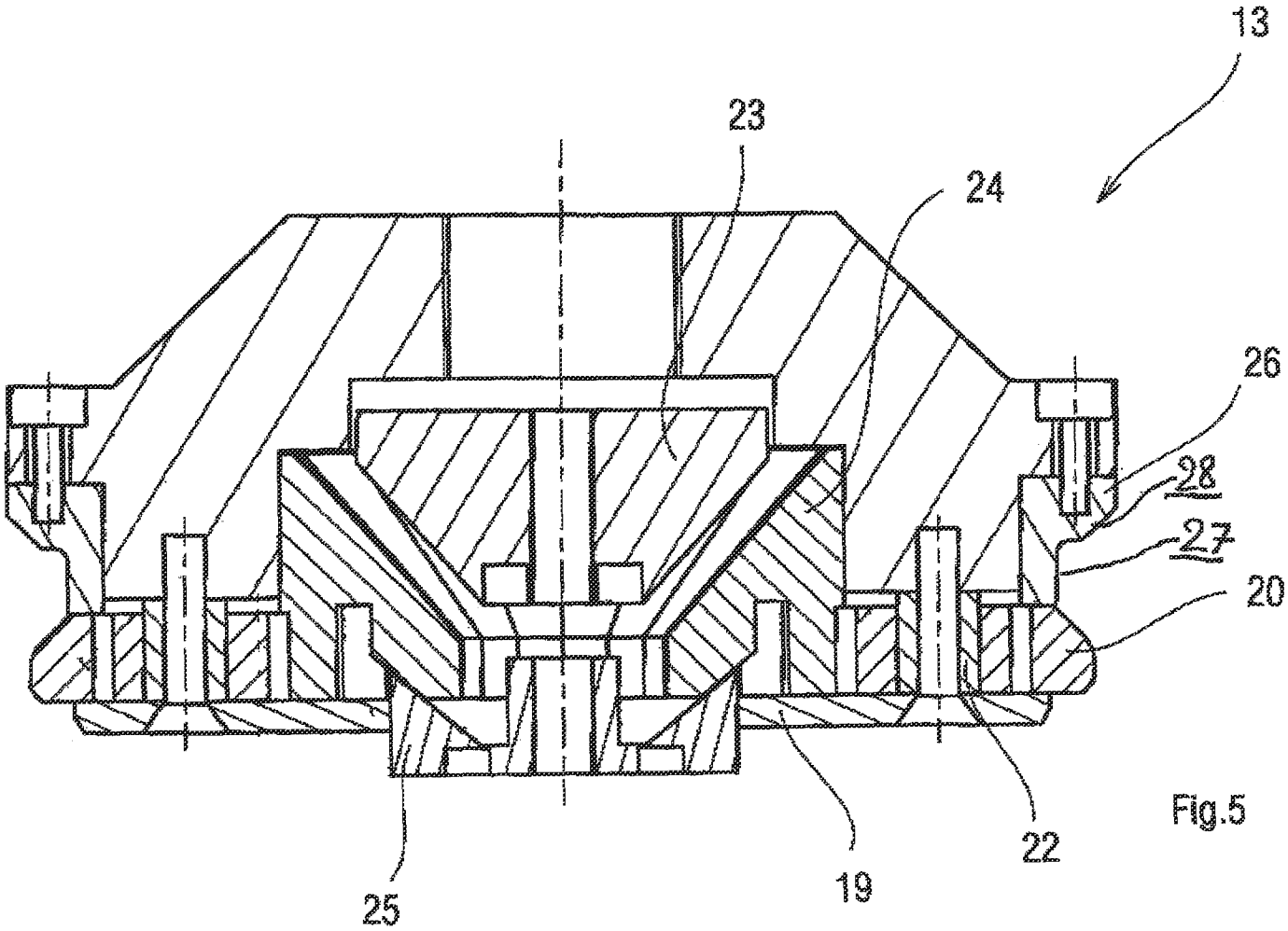
Figure 6:
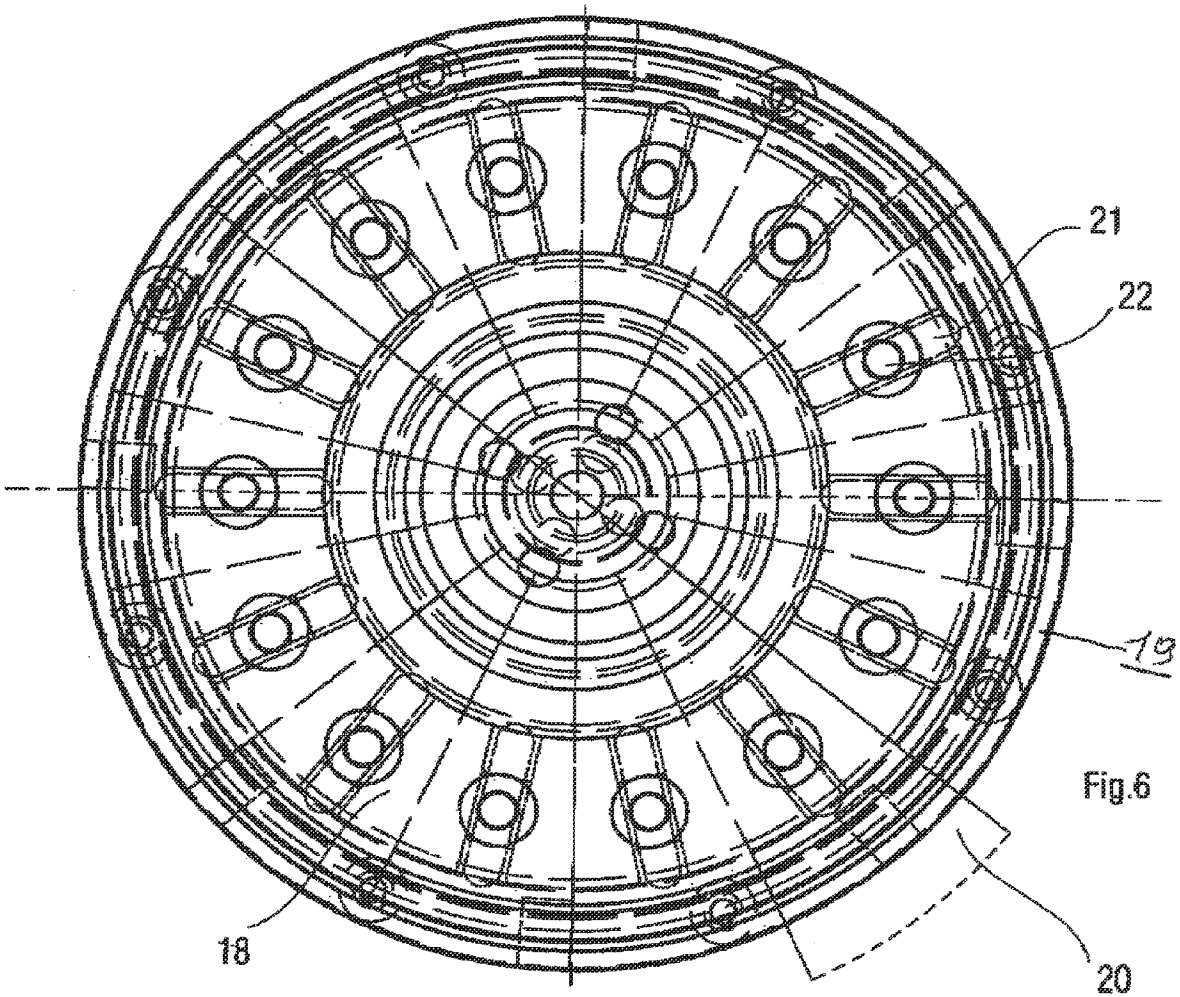
Figure 7:
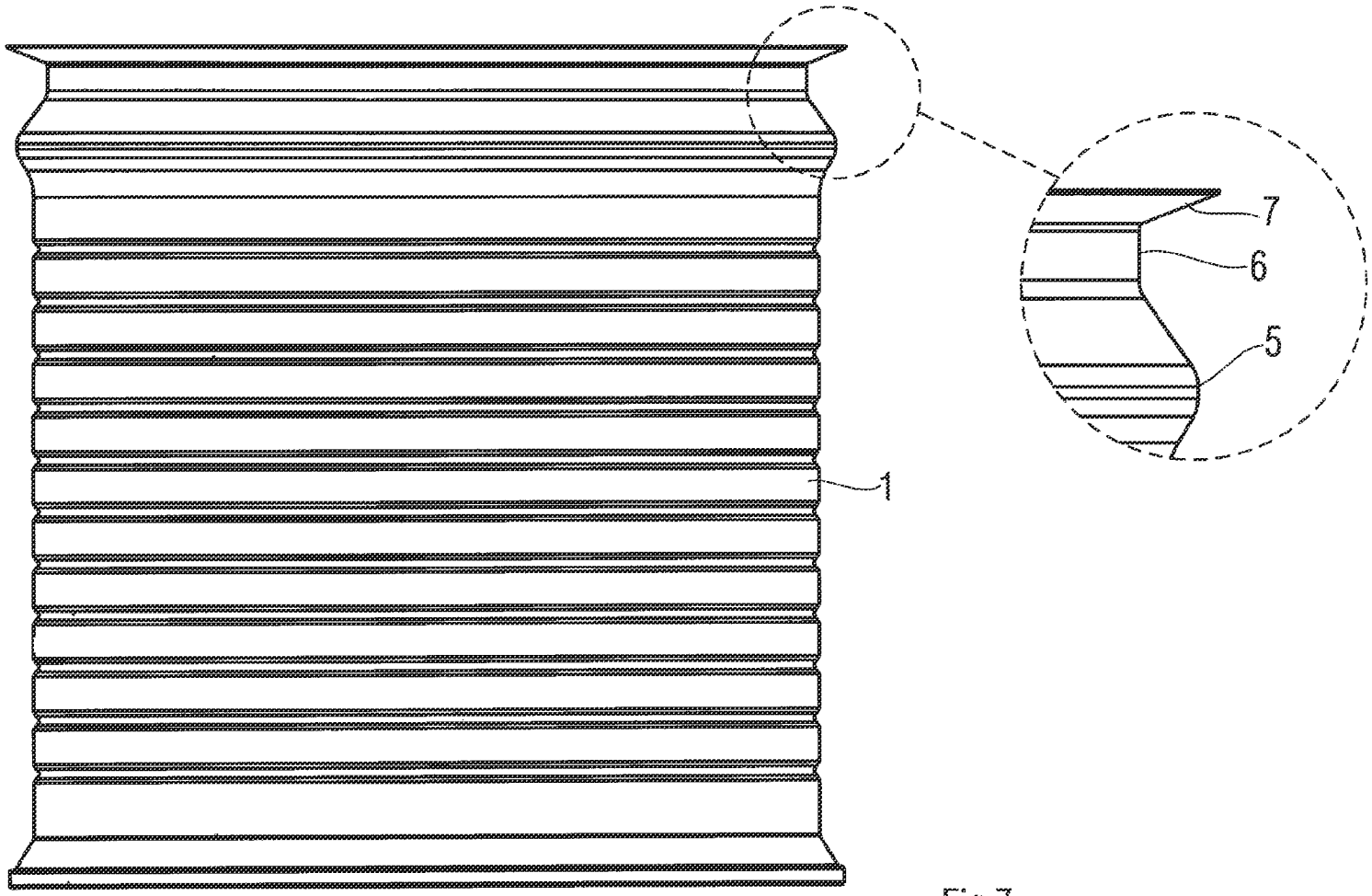
Figure 8:
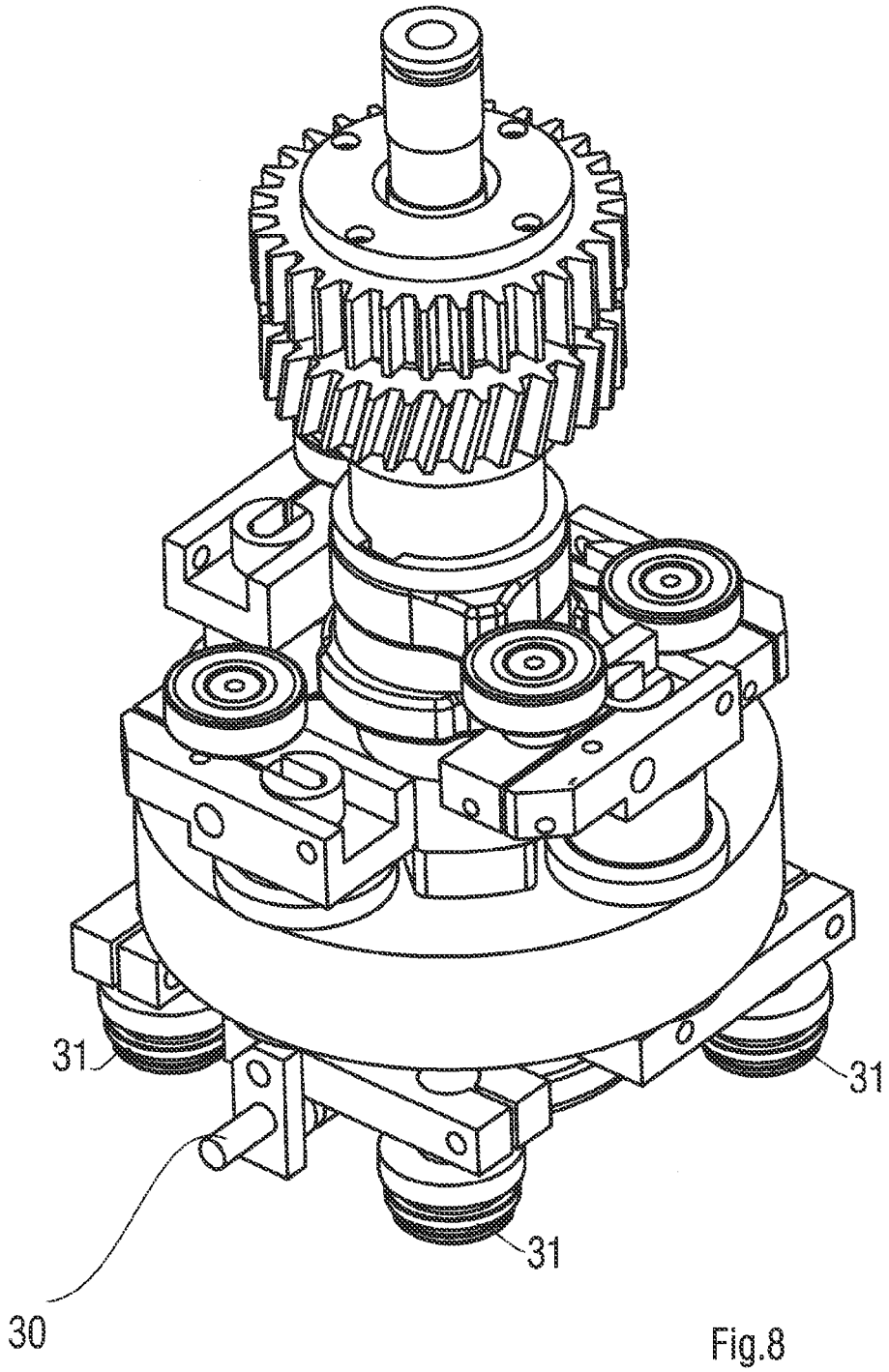
Figure 10:
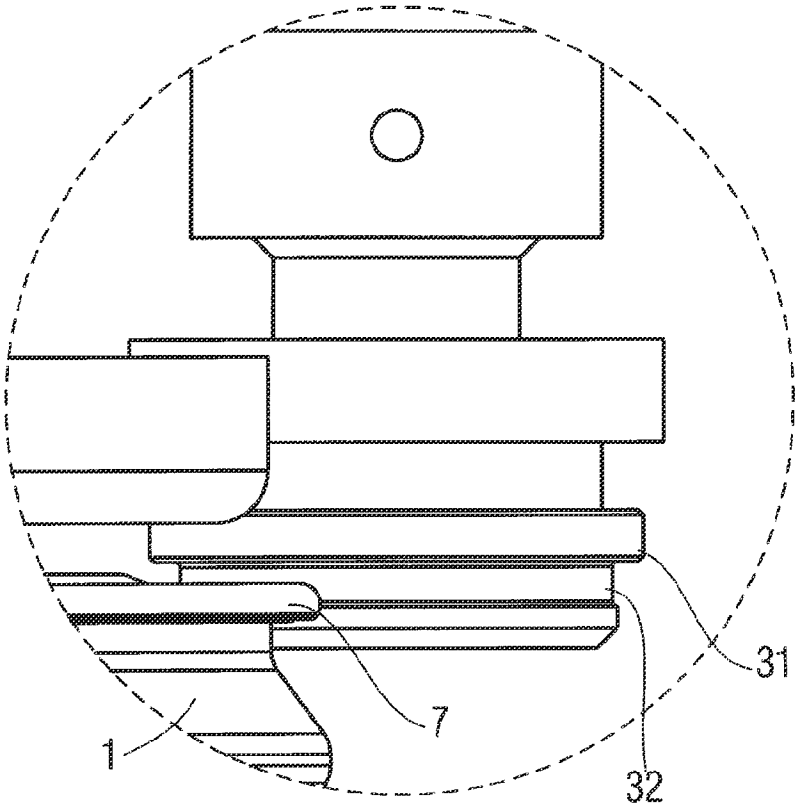
Figure 9:
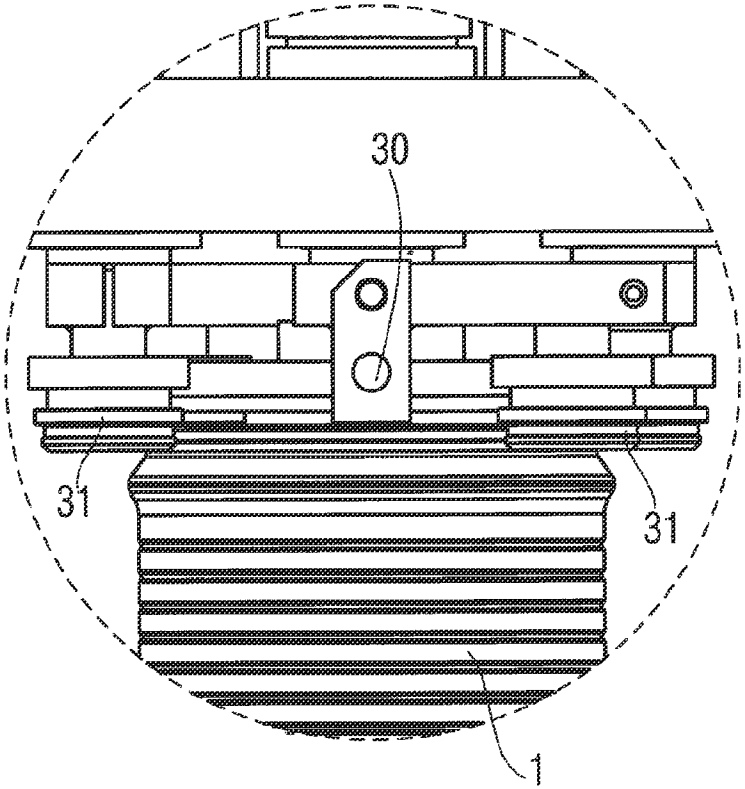

Other advantages and characteristics of the invention will emerge from reading the description below of an embodiment of the invention given by way of nonlimiting example and illustrated by the attached drawings in which:

FIG. 1 is a view of the container made after implementing the process according to the invention, FIGS. 2, 3, 4, 5, and 6 are views of the device used to carry out the first phase of the operation, namely the expansion together with the shrinkage of the mouth and the flange, FIG. 7, the drawing on page 6, is a view of the container or packaging as obtained after the first phase, FIGS. 8, 9 and 10 depict the device to implement the second phase of the invention that makes it possible to obtain the product shown in FIG. 1.

DETAILED DESCRIPTION OF THE INVENTION

The container or packaging obtained after the process is implemented according to the invention as shown in FIG. 1 is carried out starting with a cylindrical metal ring 1 that is ductile or considered to be malleable (single laminate metal), which may or may not be molded and that has at its base a crimped lid 2 (FIG. 1). The base of the ring may or may not be equipped with an extension cone 3 (FIG. 1).

The diameter of the extension cone 3 can be, for example, 157 millimeters.

The metal of the ring can originally have, for example, a hardness of 57 on the Rockwell scale and a thickness that can be, for example, 0.27 hundredth of a millimeter.

At its opening or mouth 4 (FIG. 1), the container exhibits successively from bottom to top a collar or reinforcing annular boss 5 (FIG. 1), then an annular shrinkage 6 (FIG. 1) and a rolled flange 7 (FIG. 1) that accommodates a lid 8 (FIG. 1), the internal circumference of which is equipped with a flexible seal 9 (FIG. 1) that is flattened on the rolled flange 7 (FIG. 1) under the action of the vacuum produced in the packaging according to any known technique and preferably according to the technology described in the preceding patents of the company SODETECH on this subject.

The creation of the bead by expansion can, for example, bring the internal diameter at the bead to 157 millimeters. The annular shrinkage 6 can, for example, produce an internal diameter of the opening of the can of 145 millimeters.

Figure 2:
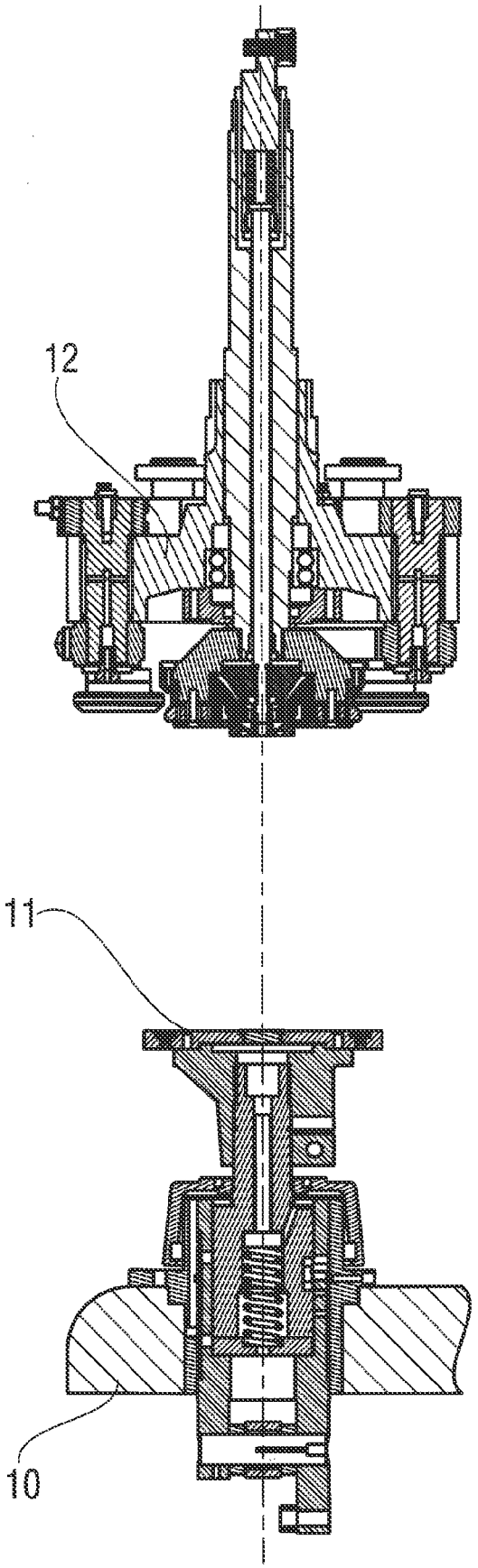

FIG. 2 illustrates a general view of the device for implementing the first operation to carry out on the packaging, i.e., a deformation by expansion of its internal diameter at the opening or mouth to create a bead under the latter and a simultaneous operation of contraction of its upper diameter as well as the production of an extending peripheral flange.

For this purpose, the device comprises, on a rotary element 10 (FIG. 2), a magnetic plate 11 (FIG. 2) that can move from top to bottom by any known means.

The magnetic plate 11 (FIG. 2) receives the packaging and raises it towards the shaping head 12 (FIG. 2) that is depicted in greater detail in FIGS. 3, 4, 5, and 6.

The head 12 (FIG. 2) is a head that carries out jointly and simultaneously the deformation of the internal diameter by expansion to produce the bead or annular boss 5 (FIG. 1) and a contraction operation 6 (FIG. 1) above the bead 5 (FIG. 1) and at the mouth or opening 4 (FIG. 1) of the can.

Figure 3:
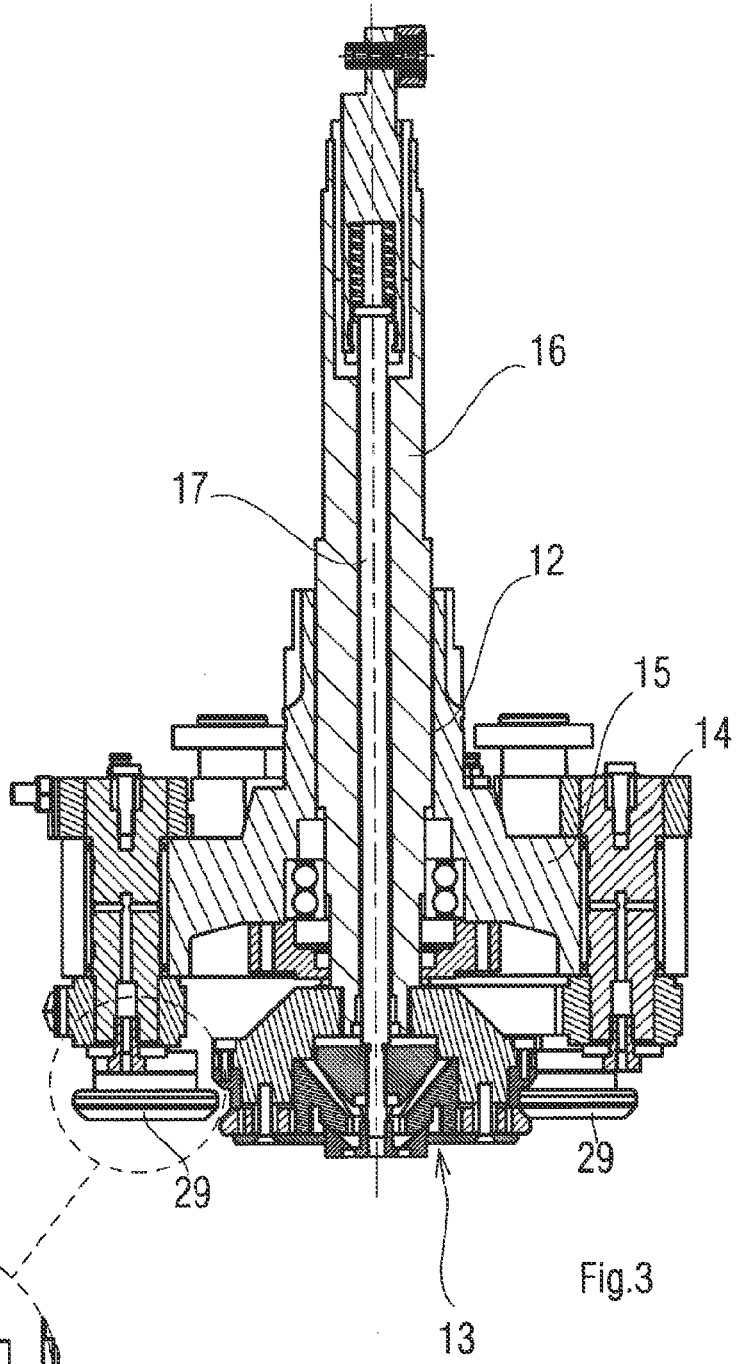

The head 12 (FIG. 2) comprises two essential components, a stationary part 13 (FIG. 3) and a moving part 14 (FIG. 3), which turns around part 13 (FIG. 3). Part 13 (FIG. 3) is illustrated in greater detail in FIG. 5.

It comprises a matrix 15 (FIG. 3) through which a dual shaft passes, one 16 (FIG. 3) being coaxial to the other 17 (FIG. 3).

The shaft, which moves from bottom to top and conversely, controls the outward positioning or the retraction of the elements producing the expansion consisting of the bead 5 (FIG. 1).

These elements consist of a disk divided into sectors 18 (FIG. 6) supported by a plate 19 (FIG. 6) on which they slide from the center towards the periphery and therefore project outward.

To facilitate understanding, FIG. 6 shows a single one of the sectors 20 expanding, but it is clear that their expansion as illustrated in FIG. 5 is simultaneous after introduction of the packaging around the base of the matrix while they are in a retracted position on the plate 19 (FIG. 5).

The expansion of the sectors 18/20 (FIG. 6) keeps the container in position together with the operation of contracting its neck.

Each sector 18 (FIG. 6) is equipped with an oblong, axial slot 21 (FIG. 6) that works with a guide 22 (FIG. 6), which makes its extraction or retraction possible.

A male cone 23 (FIG. 5) is mounted axially to the stationary matrix 13 (FIG. 5) and controlled in upward and downward movement by the internal shaft 17 (FIG. 3). This male cone 23 acts by lowering and pushing on an intermediate part forming a female cone 24 (FIG. 5), consisting of multiple sections, and actually as many as the sector 20 (FIG. 5), of which the vertical back 24 (FIG. 5) of each of said sections acts by pushing on a corresponding sector 20 (FIG. 5) to put said sector into extraction position in such a way that all of the sectors being extracted can cause expansion of the diameter of the packaging to produce the bead or annular boss 5 (FIG. 1).

Under the intermediate part 24 (FIG. 5), a female cone 25 (FIG. 5) is located at the end of the moving shaft 17 (FIG. 3) whose inclined walls in contact with the corresponding, additional walls of the part 24 (FIG. 5) make possible, by moving the cone 25 (FIG. 5) upwards, its withdrawal towards the central axis and the retraction of the sectors 20 (FIG. 5).

A stationary crown 26 (FIG. 5) is mounted annularly to the matrix 13 (FIG. 3) above the sectors 20 (FIG. 5), and said crown, during extension of the sectors 20 (FIG. 5), is set back from the latter. Said crown 26 (FIG. 5) has a vertical lower portion 27 (FIG. 5) that corresponds to the shrinkage 6 (FIG. 1) of the neck or mouth of the container and an upper portion 28 (FIG. 5) inclined outwards that corresponds to the production of the annular flange 7 (FIG. 7) that will subsequently be rolled.

The moving part 14 (FIGS. 3-4) that turns around the stationary part 13 (FIG. 3) comprises two rollers 29 (FIGS. 3 and 4) actuated while drawing near to the neck of the packaging and that, simultaneously with the expansion of the boss 5 (FIG. 1), produce, in cooperation with the crown 26 (FIG. 5), the shrinkage 6 (FIG. 1) and the peripheral flange 7 (FIG. 7) that will be turned down and rolled. The packaging at the end of this first operation is depicted in FIG. 7.

Figure 4:
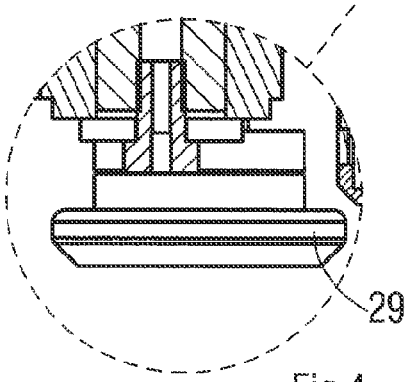

In FIG. 3, one of the rollers 29 (FIGS. 3 and 4) is depicted in position and the other at a distance as seen in the detail of FIG. 4. This representation is designed to facilitate understanding of the operation.

By withdrawal of the sectors 20 (FIG. 5), the packaging will be released and brought by the magnetic plate 11 (FIG. 2) towards the production station of the second operation of the process according to the invention, i.e., the flattening of the peripheral flange of the opening or the neck of the packaging and its rolling that, as depicted in FIG. 1, can serve as a support for the lid.

The device that makes it possible to carry out this second operation is depicted in FIGS. 8, 9 and 10.

The essential elements of this rotary device are the following:

Radial rollers 30 (FIG. 9) that are used to flatten the flange of the neck of the packaging, which, as shown 7 (FIG. 7), is in an inclined position at the end of the first operation;

Adjusting knobs 31 (FIGS. 9 and 10) that can move towards the container, each having an annular groove 32 (FIG. 10) that turns down the flange, as shown in detail in FIGS. 9 and 10, which ultimately produces the rolled flange 7 (FIG. 1).

The result of these two operations is, for the first, synchronized expansion-contraction to compress the metal and harden it by organizing the metal molecules under two simultaneous stresses while limiting disorders that might result from an expansion operation alone and especially from a contraction operation alone.

The second operation in rolling the flange makes it possible to accommodate the lid equipped with its seal.

Reinforcement of the packaging or can by the hardening operation as explained allows the packaging to accept, without deformation, sterilization under extremely rapid deep vacuum. This makes it possible to obtain a canned product of better quality than a deep-frozen product. Having the product under vacuum makes it possible to use very little liquid in the packaging, and to increase the quantity of product contained, for example, to go from 1.5 kilograms to 1.8 kilograms, without degradation of the product.

The tests performed would show that in the case of canning olives, according to the technique of the invention, the result would produce the equivalent of fresh olives, the negligible quantity of water in the packaging preventing organoleptic degradations of the product.

The deep vacuum in the packaging on the order of 900 mb (nine hundred millibars) practically eliminates any oxidation of the product and preserves the vitamins and all the natural components that are soluble in the water of the canned product.

The canned product equals the steam-cooked fresh product.

The difference obtained from the standpoint of quality of the product is due to the fact that the invention allows us to reduce the liquid in the packaging (the can) to the utmost minimum and that the deep vacuum allows for the transmission of heat to carry out sterilization by the evaporation-condensation technique in which the rapidity of exchange allows us to obtain sterilization by cooking the product very little. This is unlike the current system of heat transmission by conduction, which makes it necessary to overcook in order to sterilize.

The invention claimed is:

1. A method for forming a wall of a mouth of a cylindrical metal container from a cylindrical metal ring (1), where the mouth (4) of the container is to accommodate a sealing lid (8) equipped with an elastic seal (9) provided on an internal circumference of the lid, the lid to be secured to a flange (7) of the mouth by a vacuum created in the container, said method comprising the steps of:

beginning with the cylindrical metal ring (1) having a lower end with a base and an upper end with the mouth (4), the mouth (4) having an initial internal diameter, placing the base of the ring on a plate of a lower part of a first apparatus, the plate (11) being movable from a lower position to a raised position;

raising the ring (1) from the lower position toward a shaping head (12) of an upper part of the first apparatus located vertically above the lower part of the first apparatus so that when the plate is in the second position, the shaping head (12) is within the mouth (4) of the ring (1), the shaping head being operative to carry out deformation of the mouth by, jointly and simultaneously performing i) an expansion operation at a first region to produce a reinforcing annular boss (5) with an internal diameter greater than the initial internal diameter of the mouth, and ii) a contraction operation at a second region above the first region to produce an annular shrinkage (6) at the mouth (4) of the cylindrical metal ring (1) and above the reinforcing annular boss (5), the annular shrinkage (6) having an internal diameter less than the initial internal diameter of the mouth, such that the mouth is deformed to comprise, from bottom to top, the reinforcing annular boss (5), the annular shrinkage (6), and an initial flange (7), wherein the shaping head (12) comprises an expansible stationary part (13) and a moving part (14) that turns around the stationary part (13), said moving part (14) being coaxial with said stationary part (13); and moving the moving part (14) of the shaping head (12) around the stationary part (13) of the shaping head to deform the mouth by jointly and simultaneously executing i) the expansion operation to produce the reinforcing annular boss (5) with the internal diameter of the annular boss being greater than the initial internal diameter of the mouth, and ii) the contraction operation above the reinforcing annular boss (5) to produce that annular shrinkage (6) at the mouth (4) with the internal diameter of the annular shrinkage being less than the initial internal diameter of the mouth, and such that the mouth comprises, from bottom to top, the reinforcing annular boss (5), the annular shrinkage (6), and the initial flange (7), wherein the joint and simultaneous expansion and contraction operations providing simultaneous expansion and contraction stresses on metal molecules of the mouth of the container to harden the mouth of the container sufficiently to withstand the vacuum created in the container during the lid being secured to the mouth (4).

2. The method of claim 1, comprising the further steps of:

lower the plate from the second position and moving the ring to a second apparatus; and operating the second apparatus to turn down initial flange at an upper portion of the annular shrinkage (6) to form a final, rolled flange (7) that accepts the sealing lid (8) equipped with the elastic seal (9), wherein the second apparatus is a rotary device with i) two radial rollers (30) that, in a first operation of the second apparatus, flatten the initial flange into a flattened part (7) with an outwardly inclined position, and ii) adjusting knobs (31) that, in a second operation of the second apparatus, move towards the flatten portion, each knob comprising an annular groove (32) that carries out rolling of the flange by turning down the flattened part in the second operation to form the rolled flange (7) with a surface that accommodates the lid equipped with the seal.

3. The method of claim 2, wherein, the joint and simultaneous expansion and contraction operations provides simultaneous expansion and contraction stresses on metal molecules of the mouth of the container to harden the mouth of the container sufficiently to withstand a vacuum of nine hundred millibars created in the container during the lid being secured to the mouth (4).

4. The method of claim 2, wherein, the plate of the lower part of the first apparatus is a magnetic plate, the lower part of the first apparatus further comprises a rotary element (10), and the base of the cylindrical metal ring comprises a crimped lid (2).

5. The method of claim 2, wherein, the plate of the lower part of the first apparatus is a magnetic plate, the lower part of the first apparatus further comprises a rotary element (10), and the base of the cylindrical metal ring comprises an extension cone (3) and a crimped lid (2) mounted on the extension cone (3).

6. The method of claim 1, wherein, the cylindrical metal ring has an initial hardness of 57 on the Rockwell scale.

7. The method of claim 6, wherein, the internal diameter of the annular shrinkage is 145 millimeters, and the internal diameter of the annular boss (5) is 157 millimeters.

8. The method of claim 6, wherein an initial thickness of the cylindrical metal ring is 0.27 hundredth of a millimeter.

9. The method of claim 1, wherein, the expansible stationary part (13) comprises i) a disk divided into expansible radial sectors (18, 20) configured for outward expansion to push back a wall of the ring, and ii) a peripheral, upper, external crown (26) with a vertical lower wall (27) that corresponds to the shrinkage (6), and an outwardly inclined upper portion (28) that corresponds to the annular flange (7), and the moving part (14) comprises rollers (29) working with the vertical lower wall (27) and the inclined upper portion (28) to produce the annular shrinkage (6) and the initial flange (7), and shaping head (12) further comprises a dual shaft (16, 17), that comprising an outer shaft (16) coaxial with an internal shaft (17), that passes through the stationary and moving parts, and the step of moving the moving part (14) of the shaping head (12) around the stationary part (13) of the shaping head to deform the mouth by jointly and simultaneously, further comprises simultaneously:

moving the internal and outer shafts (16, 17) between lower positions and upper positions to control the outward positioning and retraction of the expansible radial sectors (18, 20) to the outward expansion to push back the a wall of the ring to form the annular boss (5), and controlling the rollers (29) working with the vertical lower wall (27) and the inclined upper portion (28) to produce, in cooperation with the external crown (26), the annular shrinkage (6) and the initial flange (7) simultaneously with the expansion forming the annular boss (5).

10. The method of claim 9, wherein, the expansible radial elements (18, 20) are arranged on a flat plate divided into sectors, an upper internal male cone (23) and an external female cone (25) are mounted axially to the stationary part (13) and controlled in upward and downward movement by the internal shaft (17), and the step of moving the moving part (14) of the shaping head (12) around the stationary part (13) of the shaping head to deform the mouth by jointly and simultaneously executing the expansion and contraction operations, further comprises:

controlling expansion of the radial elements (18,20) by lowering of the upper internal male cone (23), and controlling withdrawal of the radial elements (18,20) by raising of the external female cone (25).

11. The method of claim 4, comprising the further step of producing a sealed container by securing, by vacuum, the lid (8) with the elastic seal (9) sealed against the rolled flange (7).

12. A device for forming a wall of a mouth of a cylindrical metal container from a cylindrical metal ring (1) having a lower end with a base and an upper end with the mouth, the mouth having an initial internal diameter, where the mouth of the container is to accommodate a sealing lid (8) equipped with an elastic seal (9) provided on an internal circumference of the lid, the lid to be secured to a flange (7) of the mouth by a vacuum created in the container, said device comprising:

a first apparatus with a lower part located vertically below an upper part, the lower part comprising a plate (11) adapted to hold the cylindrical metal ring (1), the upper part comprising a shaping head (12), the plate (11) being movable from a lower position to a raised position, wherein, with plate holding the ring (1) in the raised position with the shaping head (12) within the mouth (4) of the ring (1), the shaping head is operative to carry out deformation of the mouth by, jointly and simultaneously performing i) an expansion operation at a first region to produce a reinforcing annular boss (5) with an internal diameter greater than the initial internal diameter of the mouth, and ii) a contraction operation at a second region above the first region to produce an annular shrinkage (6) at the mouth (4) of the cylindrical metal ring (1) and above the reinforcing annular boss (5), the annular shrinkage (6) having an internal diameter less than the initial internal diameter of the mouth, such that the mouth is deformed to comprise, from bottom to top, the reinforcing annular boss (5), the annular shrinkage (6), and an initial flange (7), wherein the shaping head (12) further comprises an expansible stationary part (13) and a moving part (14) that turns around the stationary part (13), said moving part (14) being coaxial with said stationary part (13), wherein the shaping head is operative so that moving the moving part (14) of the shaping head (12) around the stationary part (13) of the shaping head deforms the mouth by jointly and simultaneously executing i) the expansion operation to produce the reinforcing annular boss (5) with the internal diameter of the annular boss being greater than the initial internal diameter of the mouth, and ii) the contraction operation above the reinforcing annular boss (5) to produce that annular shrinkage (6) at the mouth (4) with the internal diameter of the annular shrinkage being less than the initial internal diameter of the mouth, and such that the mouth comprises, from bottom to top, the reinforcing annular boss (5), the annular shrinkage (6), and the initial flange (7), and wherein the joint and simultaneous expansion and contraction operations providing simultaneous expansion and contraction stresses on metal molecules of the mouth of the container to harden the mouth of the container sufficiently to withstand the vacuum created in the container during the lid being secured to the mouth (4).

13. The device of claim 12, further comprising:

a second apparatus that is a rotary device with i) two radial rollers (30) that, in a first operation of the second apparatus, flatten the initial flange into a flattened part (7) with an outwardly inclined position, and ii) adjusting knobs (31) that, in a second operation of the second apparatus, move towards the flatten portion, each knob comprising an annular groove (32) that carries out rolling of the flange by turning down the flattened part in the second operation to form a final, rolled flange (7) with a surface that accommodates the lid equipped with the seal, wherein, operation of the second apparatus turns down the initial flange at an upper portion of the annular shrinkage (6) to form the final, rolled flange (7) that accepts the sealing lid (8) equipped with the elastic seal (9).

14. The device of claim 12, wherein, the plate of the lower part of the first apparatus is a magnetic plate, and the lower part of the first apparatus further comprises a rotary element (10).

15. The device of claim 12, wherein, the expansible stationary part (13) comprises i) a disk divided into expansible radial sectors (18, 20) configured for outward expansion to push back a wall of the ring, and ii) a peripheral, upper, external crown (26) with a vertical lower wall (27) that corresponds to the shrinkage (6), and an outwardly inclined upper portion (28) that corresponds to the annular flange (7), and the moving part (14) comprises rollers (29) working with the vertical lower wall (27) and the inclined upper portion (28) to produce the annular shrinkage (6) and the initial flange (7), and shaping head (12) further comprises a dual shaft (16, 17), that comprising an outer shaft (16) coaxial with an internal shaft (17), that passes through the stationary and moving parts, wherein, moving the internal and outer shafts (16, 17) between lower positions and upper positions controls the outward positioning and retraction of the expansible radial sectors (18, 20) to the outward expansion to push back the a wall of the ring to form the annular boss (5), and controlling the rollers (29) working with the vertical lower wall (27) and the inclined upper portion (28) produces, in cooperation with the external crown (26), the annular shrinkage (6) and the initial flange (7) simultaneously with the expansion forming the annular boss (5).

16. The device of claim 15, wherein, the expansible radial elements (18, 20) are arranged on a flat plate divided into sectors, an upper internal male cone (23) and an external female cone (25) are mounted axially to the stationary part (13) and controlled in upward and downward movement by the internal shaft (17), moving the moving part (14) of the shaping head (12) around the stationary part (13) of the shaping head deforms the mouth by jointly and simultaneously executing the expansion and contraction operations, by i) controlling expansion of the radial elements (18,20) by lowering of the upper internal male cone (23), and ii) controlling withdrawal of the radial elements (18,20) by raising of the external female cone (25).

* * * * *